US008136573B2

(12) United States Patent
Renkel

(10) Patent No.: US 8,136,573 B2
(45) Date of Patent: Mar. 20, 2012

(54) METHOD FOR PRODUCTION OF TURBINE BLADES BY CENTRIFUGAL CASTING

(76) Inventor: Manfred Renkel, Bad Staffelstein (DE)

( * ) Notice: Subject to any disclaimer, the term of this patent is extended or adjusted under 35 U.S.C. 154(b) by 390 days.

(21) Appl. No.: 12/310,925

(22) PCT Filed: Feb. 7, 2007

(86) PCT No.: PCT/EP2007/001024

§ 371 (c)(1),
(2), (4) Date: May 8, 2009

(87) PCT Pub. No.: WO2008/049465

PCT Pub. Date: May 2, 2008

(65) Prior Publication Data

US 2010/0000706 A1 Jan. 7, 2010

(30) Foreign Application Priority Data

Oct. 23, 2006 (WO) ..... PCT/EP2006/010191

(51) Int. Cl.
*B22D 13/06* (2006.01)

(52) U.S. Cl. ..... 164/114; 164/118; 164/286; 164/289

(58) Field of Classification Search ..... 164/114, 164/118, 286, 289, 290
See application file for complete search history.

(56) References Cited

U.S. PATENT DOCUMENTS

| | | | | |
|---|---|---|---|---|
| 5,284,620 | A | 2/1994 | Larsen, Jr. | |
| 5,671,533 | A | 9/1997 | Dillamore et al. | |
| 6,776,214 | B2 | 8/2004 | Ray et al. | |
| 7,389,809 | B2 | 6/2008 | Renkel et al. | |
| 2001/0045267 | A1 * | 11/2001 | Choudhury et al. | 164/118 |
| 2002/0179275 | A1 * | 12/2002 | Blum et al. | 164/114 |
| 2005/0016706 | A1 * | 1/2005 | Ray et al. | 164/97 |
| 2005/0279481 | A1 * | 12/2005 | Renkel et al. | 164/114 |

FOREIGN PATENT DOCUMENTS

| | | | |
|---|---|---|---|
| JP | S55-081052 | A | 6/1980 |
| JP | H06-033701 | A | 2/1994 |
| WO | WO 03074210 | A2 * | 9/2003 |

OTHER PUBLICATIONS

McKelvey et al., High-temperature fracture and fatigue-crack growth behavior of and XD gamma-bases titanium aluminide intermetallic alloy, Metallurgical and Material Transactions A, May 2000, pp. 1413-1423.*

Ti-Al phase diagram, http://www.calphad.com/titanium-aluminum.html, date unknown.*

* cited by examiner

*Primary Examiner* — Jessica L Ward
*Assistant Examiner* — Kevin E Yoon
(74) *Attorney, Agent, or Firm* — Manabu Kanesaka

(57) ABSTRACT

A turbine blade having a leading edge portion and a flowing-off edge portion is formed using the following steps: providing a centrifugal casting device having a rotor and at least one crucible being accommodated in the rotor; providing a mold having an extended cavity for forming the turbine blade; arranging the mold so that an inlet opening of the mold is arranged with an outlet opening of the crucible, and further arranging the mold so that a mold leading edge is directed in a direction against the rotational direction of the rotor; forcing a metal melt by means of centrifugal forces from the crucible into the mold; exerting a pressure on the melt being forced into the mold until the temperature of the solidifying melt has reached a predetermined cooling-temperature; and relieving the pressure when the temperature of the solidifying melt is below the predetermined cooling-temperature.

29 Claims, 7 Drawing Sheets

METHOD FOR PRODUCTION OF TURBINE BLADES BY CENTRIFUGAL CASTING

Background Of The Invention And Related Art Statement.

The invention pertains to a method for production of turbine blades by centrifugal casting. The method in particular pertains to the production of turbine blades made of titanium or alloys containing large amounts of titanium, e.g. titanium aluminides.

Especially titanium aluminides are considered an optimum material in various areas of application because of their low density, relatively high-temperature, specific strength relative to nickel superalloys, and corrosion resistance. However, materials with a narrow range between solidus and liquidus temperature, like TiAl or pure titanium grade 2, are very difficult to shape, the only practical method for forming them is to cast them.

When casting such materials one is encountered with further problems like an unusual high amount of shrinkage of the intermetallic phase (γ-TiAl) during solidification resulting in the formation of shrinkholes, voids, pores, etc. in castings. This makes it usually necessary to reprocess the casting by expensive high-pressure compaction (HIP method).

Further, when casting such materials in molds having a complicated geometry, like shrouded tubine blades, the casting frequently shows damages shows damages like cracks, e.g. hot tears, or even torn off blade shrouds. These are strain induced damages corresponding to a rapid shrinkage during the solidification process.

SUMMARY OF THE INVENTION

An object of the present invention is it to avoid the disadvantages in the art. It is an aim of the present invention to provide a method allowing a production of castings having less pores, shrinkholes, voids and the like, thereby avoiding an expensive reprocessing by high-pressure compaction. A further aim of the present invention is to provide a method by which castings having a complicated geometry can be produced without strain induced damages.

In accordance with the present invention there is provided a method for production of a turbine blades by centrifugal casting, the turbine blade having a leading edge portion with a first thickness and a flowing-off edge portion with a second thickness being smaller than the first thickness, comprising the following steps:

a) providing a centrifugal casting device having a rotor being rotatable around an axis, and at least one crucible being accommodated in the rotor, the crucible having at least one outlet opening,
b) providing a mold having an extended cavity for forming the turbine blade,
c) arranging the mold at a radially outward position with respect to the crucible, so that an inlet opening of the mold is arranged vis-a-vis with an outlet opening of the crucible, and further arranging the mold so that a mold leading edge is directed in a direction against the rotational direction of the rotor,
d) rotating the rotor and thereby forcing a metal melt by means of centrifugal forces from the crucible into the mold,
e) exerting a pressure on the melt being forced into the mold until the temperature of the solidifying melt has reached a predetermined cooling-temperature, and f) relieving the pressure when the temperature of the solidifying melt is smaller than said predetermined cooling-temperature.

In the sense of the present invention under a "crucible" there is in general understood a container which has sufficient heat resistance to take up a metallic melt without being damaged and without undergoing reactions with the metal melt. A "crucible" in the sense of the present invention may have any suitable shape. In particular it may have a cylindrical shape the bottom of which has a rounded concave shape. However, a "crucible" in the sense of the present invention may also be formed as a ring-like channel. Suitable materials for the production of a crucible are alumina, $Y_2O_3$, magnesia, silica glass, graphite and the like.

A turbine blade is in its cross section formed similar like a wing of an aircraft. The turbine blade has a leading edge portion with a first thickness and a flowing-off edge portion with a second thickness being smaller than the first thickness.

According to the invention it is provided that a mold leading edge which corresponds to the leading edge of the turbine blade is directed in a direction against the rotational direction of the rotor. Under the term "against the rotational direction of the rotor" it is understood that a connecting-plane connecting the mold leading edge with the mold flowing-off edge is arranged either in coincidence with a radial plane of the rotor or is arranged at an angle of up to +/−90° with respect to the radial plane. Under the "term radial" plane there is understood a plane which runs perpendicular to the rotational axis of the rotor.

By arranging the mold with its mold leading edge against the rotational direction of the rotor surprisingly the formation of pores and shrinkholes within the turbine blade, in particular within the leading edge portion thereof, can be avoided. It is assumed that when arranging the mold as proposed by the invention due to Coriolis-forces a higher pressure is exerted upon the melt in the leading edge portion than if the leading edge of the mold would be arranged in the rotational direction of the rotor.

According to an embodiment of the invention a connecting plane connecting the mold leading edge and the mold flowing-off edge is arranged with an angle of 2° to 45° relative to a radial plane of the rotor. Further, the leading edge can be arranged not only in parallel with a radial direction but also at a first angle $\alpha 1$ relative to the radial direction of the rotor. Preferably the first angle $\alpha 1$ opens in a direction against the direction of rotation of the rotor. That means that the mold may be arranged such that the leading edge is inclined in a direction against the rotational direction of the rotor. The first angle $\alpha 1$ may be up to 30°. By the aforementioned measures a further reduction of pores and shrink-holes in the casting can be achieved.

According to a further embodiment of the method the mold leading edge may be arranged in an axial plane at a second angle $\alpha 2$, of preferably up to 30°, relative to the radial direction of the rotor. Preferably the second angle $\alpha 2$ opens in a direction in which gravity acts. That means that the leading edge may be inclined with respect to the radial or horizontal plane at a first and/or second angle. Also this measure has the effect of reducing pores and shrinkholes.

The method according to the invention differs further from conventional methods in particular in that there is exerted a pressure on the melt after the mold has completely been filled.

The pressure may be exerted on the melt until the predetermined cooling-temperature is in a range of 1300° C. to 800° C. The predetermined cooling-temperature depends on the used metal alloy. The predetermined cooling-temperature is advantageously selected to be lower than a brittle-ductile transition temperature of the used alloy. Under the term "brittle-ductile transition temperature" there is understood a temperature at which the bonds of an intermetallic phase change from metal bonds to atomic bonds. At temperatures above the brittle-ductile transition temperature intermetallic phases are bond by metal bonds. At such temperatures intermetallic phases are ductile. At a temperature below the brittle-ductile transition temperature intermetallic phases change their properties and become brittle. The predetermined cooling-temperature can be chosen to be for example 20° C. to 200° C. lower than the brittle-ductile transition temperature. The amount of the pressure which is exerted on the melt after the mold is completely filled corresponds to the centrifugal force acting on the melt at the moment when the mold is completely filled times a factor of 1.0 to 5.0. The centrifugal force depends on the rotational speed of the rotor, the first radius at which the mold is distanced from the axis and the mass of the melt. Under the term "first radius" there is understood the distance between the axis and an inlet opening of the mold. According to the invention the pressure to be exerted on the melt is the centrifugal force at the precise moment of completely filling of the mold times a factor which is selected from a range of 1.0 to 5.0. From this relation one can calculate a suitable pressure to be exerted on the melt for molds being placed at a different first radius from the axis as well as for any mass of metal melt which is taken up in the mold. As can be seen from the above relation the pressure being exerted upon the melt after the mold is completely filled may be higher than during the time when the mold is being-filled. According to an embodiment the pressure may be increased after the mold has been filled, preferably at a constant rate, for a predetermined period and afterwards there may be exerted a constant pressure on the melt. The predetermined period may be in the range of 1 to 25 seconds, preferably 5 to 20 seconds. The period of the constant pressure may be in range of 1 to 6 minutes, preferably of 4 to 6 minutes.

When reaching the predetermined cooling-temperature the pressure is relieved so that in maximum the atmospheric pressure is acting upon the melt.

By the proposed exerting of a pressure on the solidifying melt being hotter than the predetermined cooling-temperature a formation of pores, voids, shrinkholes and the like in the castings can be significantly reduced. It is in particular not necessary to reprocess the casting by high-pressure compaction. A particular advantage is that a formation of strain induced damages can be avoided even when producing castings with a complicated geometry, like shrouded turbine blades and vane clusters.

According to an advantageous embodiment the pressure exerted upon the melt is a constant or increasing pressure. In order to create the required pressure the rotor may be rotated with the same or an increasing speed during step lit. e).

According to a further embodiment of the invention the melt is heated up to a temperature which is 50° C. to 150° C. higher than the melting temperature of the metal. By this measure the heat energy of the melt is increased. When using such a superheated melt in particular an undesirable formation of cold runs in molds for castings having thick wall sections, i.e. sections with a thickness in the range of 0.5 mm, can be avoided.

According to a further advantageous feature the mold is preheated before step c). The temperature of said preheating may be in the range of 50° C. to 1100° C., preferably the range of 850° C. to 1100° C. Such a preheating temperature is in particular useful when producing turbine blades. For example for the production of turbo charger wheels it has been proofed to be advantageous to use a temperature for said preheating in the range of 50° C. to 250° C.—It has to be understood that the preheating temperature of the mold depends from the geometry of the casting and has to be determined for each geometry.

The preheating of the mold can take place for example in a furnace from which the mold is transferred into the rotor before a centrifugal casting takes place. However, it is also possible to preheat the mold by suitable heating device being provided at the centrifugal casting device, in particular at the rotor. By preheating the mold an undesirable quenching of the melt being forced into the mold can be avoided. Surface quality of the casting can be improved. By preheating the mold in particular an undesirable reaction of the melt with the mold material can be counteracted.

According to a further advantageous feature the predetermined cooling-temperature is in a range of 1050° C. to 800° C. Predetermined cooling-temperatures selected from this range are usually lower than the brittle-ductile transition temperature of titanium aluminides. When choosing a cooling-temperature from the proposed range and exerting a pressure upon the melt until the chosen predetermined cooling-temperature is reached castings made of titanium aluminides can be produced with an excellent quality.

The pressure can be exerted upon the melt in different manners. According to a simple embodiment the pressure is exerted upon the melt by rotating the rotor. In this case the pressure is created by centrifugal forces acting upon the melt. However, it is also possible to exert the pressure upon melt for example by pressurised gas. In this case as gas there may be used preferably an inert gas like Argon or the like.

According to a further embodiment of the invention during steps d) and e) the melt is under vacuum or shield gas. In particular the use of vacuum is advantageous as therewith a formation of gas-filled pores and an oxidation of the metal, in particular of titan aluminides, can be avoided. It has been proven appropriate to use a vacuum of $\mathbf{10^{-1}}$ to $\mathbf{10^{-2}}$ bar in order to avoid the formation of in particular gas-filled pores.

According to a further embodiment the solidifying melt is cooled down after step e) to room temperature at a cooling-rate of 50° C. to 150° C. per hour. Such a cooling-rate can be realised by the use of molds having suitable thermal isolation properties. Molds without suitable thermal isolation properties may be placed in a furnace which is preheated upon a temperature which is in the range of the predetermined cooling-temperature. After transferring the mold into the furnace it may be cooled down by controlling the heating elements of the furnace so that the aforementioned cooling-rate is realised within the furnace. The proposed controlled cooling down of the mold also counteracts the formation of hot tears in the casting.

The proposed method is in particular well suited for producing castings from a metal melt consisting of a titanium alloy. The titanium alloy advantageously comprises Ti and Al as main constituents. A suitable composition (in at. %) of a γ-TiAl based alloy may be summarised as follows:

$$Ti_{45\text{-}52}\ \text{at. \%}\ Al_{45\text{-}48}\ \text{at. \%}\ X1_{1\text{-}3}\ \text{at. \%}\ X2_{2\text{-}4}\ \text{at. \%}\ X3_{1}\ \text{at. \%},$$

where

X1=Cr, Mn, V

X2=Nb, Ta, W, Mo

X3=Si, B, C.

For example, the titanium alloy may contain 30 to 45 wt. % Al, 1.5 to 6 wt. % Nb and as balance Ti as well as unavoidable impurities. The titanium alloy may further contain one or more of the further constituents: 0.5 to 3.0 wt. % Mn, 0.1 to 0.5 wt. % B, 1.5 to 3.5 wt. % Cr. Further, the titanium alloy may contain O in an amount of 0 to 1000 ppm, C in an amount of 0 to 1000 ppm, preferably 800 to 1200 ppm, Ni in an amount of 100 to 1000 ppm and N in an amount of 0 to 1000 ppm.

According to an embodiment of the invention the crucible is accommodated in the rotor at a second radial distance from the axis, the second radial distance being smaller than the first radial distance. The second radial distance may be calculated from an outlet opening of the crucible to the axis. Usually, the second radial distance is larger than a diameter of the crucible. If the crucible and the associated mold are both accommodated eccentrically with respect to the axis of the rotor it is possible to create higher centrifugal forces acting upon the melt at comparable rotating speeds. Thereby the mold can rapidly be filled and the formation of cold runs can be avoided. This further improves the quality of the casting in that less pores, voids or shrinkholes are created.

It is possible to create the melt in the crucible while the rotor is standing, i.e. while the rotor is not rotating. In this case the melt can be created by inductively heating an ingot within the crucible. It is also possible to heat the ingot or to support the heating of the ingot by microwaves. By the proposed heating methods an ingot can be melt within several minutes.

Alternatively, the metal melt may also be poured into the crucible. This allows a production of larger quantities of metal melt. If in the rotor there is accommodated a multitude of molds, a multitude of castings can be produced simultaneously.

According to a further embodiment the melt may be poured into the crucible while the rotor is rotating. By this measure the melt being poured into the crucible can be accelerated rapidly and can be forced with a high speed into the mold. Consequently, the mold is filled with the melt being at a relatively high temperature which in turn guaranties a certain mobility of the melt and therefore the pressure being exerted upon the melt during step d) can effectively be used to cold runs and to reduce pores.

It has been proven appropriate that the crucible has the form of a ring-shaped channel being centrally accommodated in the rotor, the outer circumference of which having a second radial distance from the axis, the second distance being smaller than the first radial distance. According to this feature the melt is poured into a ring-shaped channel at a radial distance with respect to the axis. Consequently, the centrifugal force acting upon the melt and therefore the velocity by which the melt is transferred into the mold can be increased by this measure.

With respect to further embodiments of the alternative method reference is made to the above transcription of the embodiments regarding the method. The features described there can be also embodiments of the alternative method.

BRIEF DESCRIPTION OF THE DRAWINGS

Embodiments of the invention are now described in detail with reference to the accompanied figures.

DETAILED DESCRIPTION OF THE PREFERRED EMBODIMENTS.

Figure 1:
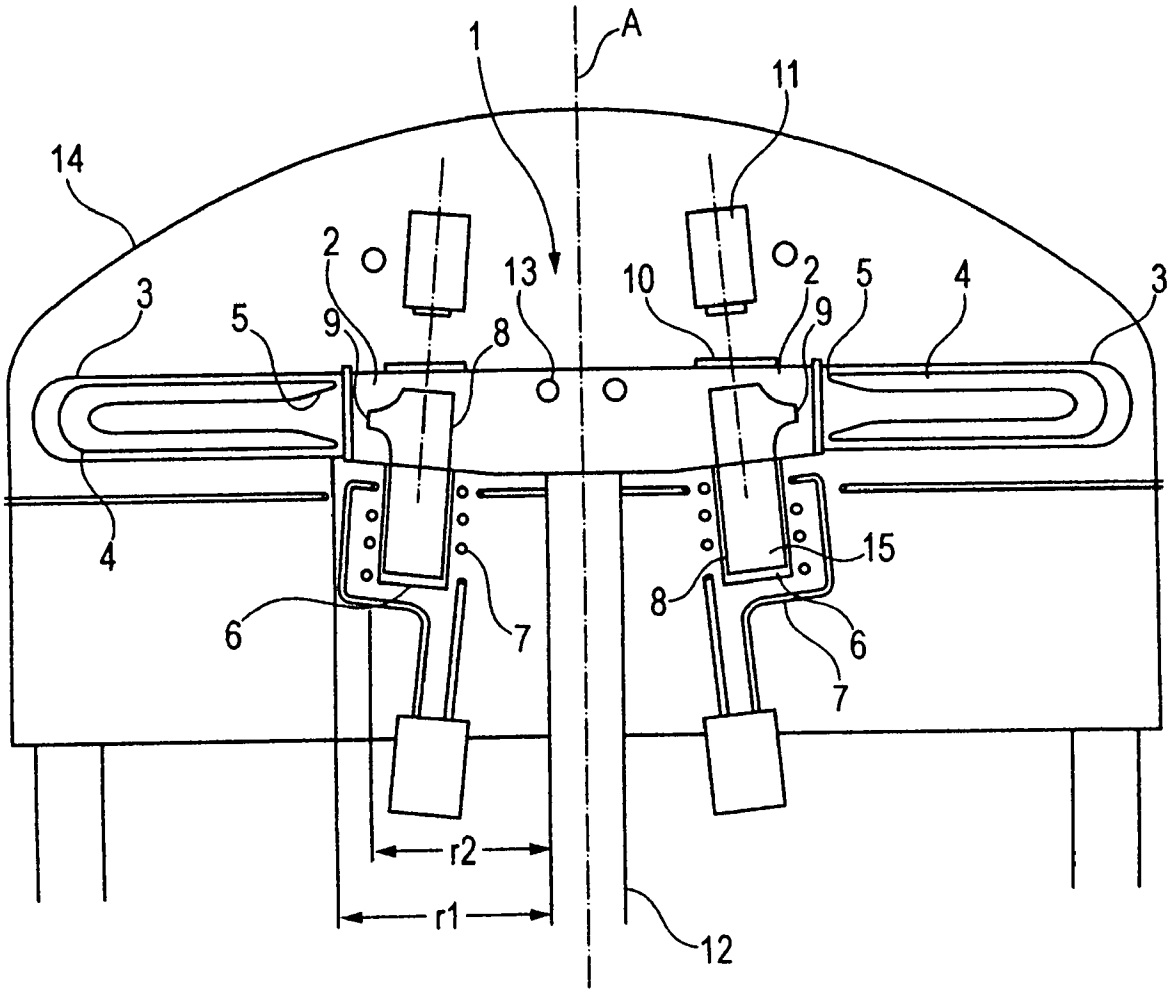
FIG. 1 shows a sectional drawing of a first device.

FIG. 1 shows a rotor 1 which is rotatable around an axis A. The rotor 1 comprises two hollow tube-like arms 2. At the outer end of each arm 2 there is realisably mounted, preferably in a gas-tight manner, a piston 3. In the piston 3 there is accommodated a mold 4 having a funnel-like inlet opening 5 which is directed to the axis A.

Nearby the outer end of each arm 2 there is provided a first crucible 6 made of a heat resistant material, e.g. silica glass or the like. The first crucible 6 is mounted at a bottom of the arm 2, preferably in a gas-tight manner.

The first crucible 6 is surrounded by an induction-coil 7 which can be moved in an essentially vertical direction. In an lower position (not shown here) of the induction-coil 7 it does not surround the first crucible 6 so that the first crucible 6 can be rotated with the rotor 1 around the axis A. Within the first crucible 6 there is accommodated a second crucible 8 having a outlet opening 9 which is placed opposite to the inlet opening 5 of the mold 4.

The second crucible 8 is made of a heat-resistant material, e.g. alumina, $Y_2O_3$, graphite or the like. According to a preferred embodiment of the invention the second crucible 8 is made of alumina, magnesia or the like. There may be provided a third crucible (not shown here) made of graphite which may be placed within the second crucible 8. By the use of the third crucible an inductive melting of an ingot taken up therein can be accelerated.

Opposite to a bottom of the second crucible 8 there is provided a window 10 through which by means of a camera 11 the melting of the ingot may be observed.

A hollow shaft 12 extending vertically from the rotor 1 may be driven by an electric motor (not shown here).

In an embodiment of the invention there is provided a vacuum source, e.g. a vacuum pump or the like, which is connected by means of a conventional sealing with the hollow shaft 12 to create within the rotor 1, which is designed in this case in a gas-tight manner, a vacuum.

In a second embodiment of the invention the rotor 1 may have breakthroughs 13. The rotor 1 may be surrounded by a gas-tight housing 14. The vacuum source may be connected to the gas-tight housing 14 to create therein and thereby also within the rotor 1 a vacuum.

In another embodiment of the invention there is provided instead of a vacuum source a source of a shield gas, e.g. Ar or the like, by which the hollow structure surrounded by the rotor 1 may be flooded during the centrifugal casting process.

As can be seen from FIG. 1 the mold is accommodated within the rotor 1 at a first radial distance r1 and the second crucible 8 taking up a melt 15 is accommodated within the arm 2 at a second radial distance r2. Under the first radial distance there is understood a distance between then inlet opening 5 and the axis A; under the second radial distance there is understood the distance between the outlet opening 5 and the axis A. As can be seen from FIG. 1 the first radial distance is larger than the second radial distance. Further, the second crucible has a cylindrical shape and the second radius is larger than the diameter of the crucible, i.e. the second crucible 8 is located eccentrically with respect to the axis A within the rotor 1.

It has to be understood that the rotor 1 may comprise more than two arms 2, e.g. 4, 6, 8 or more arms. The rotor 1 may also be disk-shaped.

According to a further embodiment within the rotor 1 there may also be accommodated a first and a second crucible which are formed like ring-channels. These ring like channels again may be made for example of a heat-resistant ceramic like silica-glass, alumina, graphite and the like. One or more ingots taken up in the second crucible, which is formed as a ring-channel, may be again heated by an induction-coil, which surrounds an inner and an outer diameter of the first crucible, which is as well formed like a ring-channel and which accommodates the second ring-channel like crucible.

The second ring-channel like crucible may have several outlet openings. Vis-à-vis each outlet opening there is accommodated in a radial direction a corresponding mold with their inlet opening.

Figure 2:
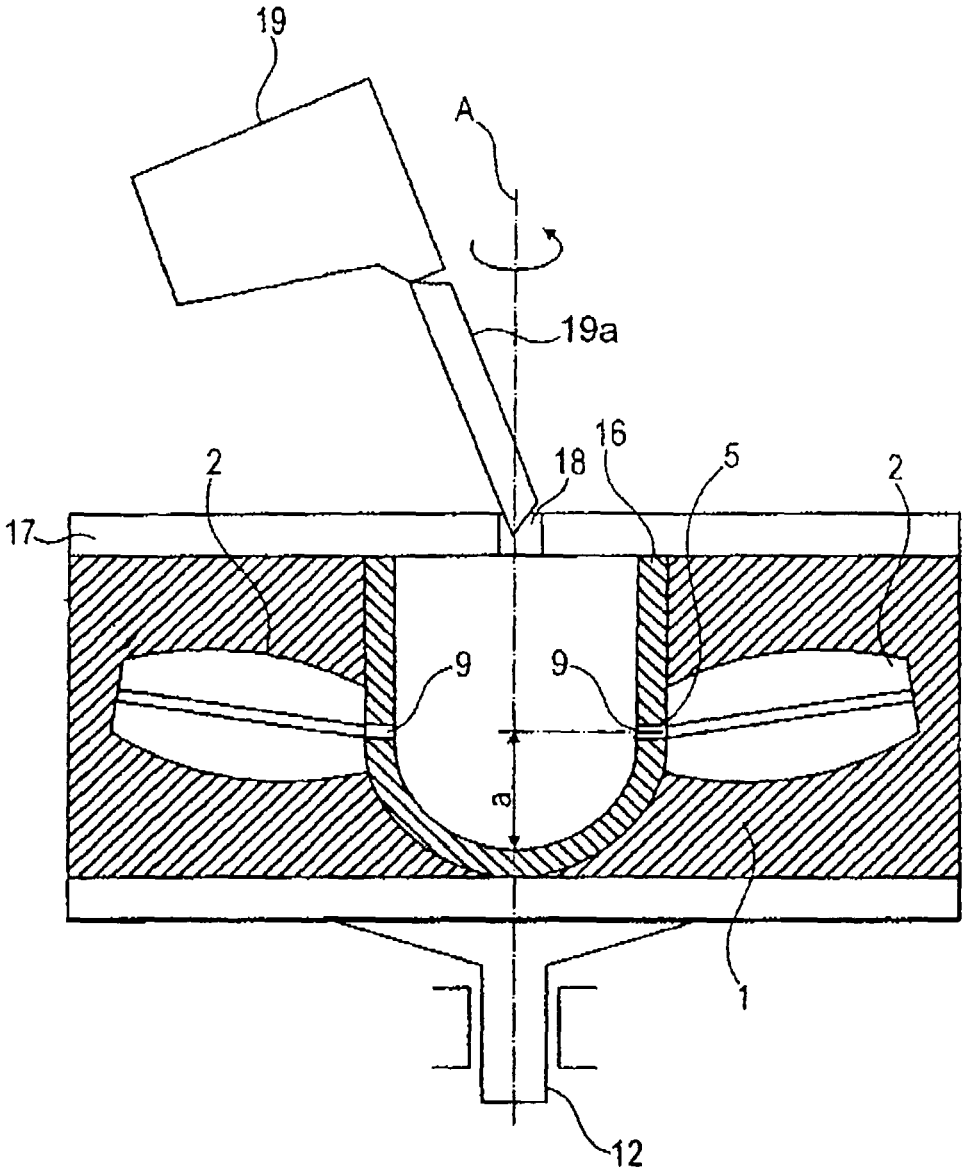
Fig. 2 PRIOR ART
FIG. 2 shows a sectional drawing of a second device.

FIG. 2 shows a second device in the rotor 1 of which there is centrically accommodated a fourth crucible 16, which may be made of alumina, $Y_2O_3$ or the like. Vis-à-vis second openings 9 of the fourth crucible 16 there are provided molds 2 with their inlet openings 5 being located vis-à-vis the outlet openings 9. The inlet openings 5 are arranged again in a first radial distance r1 from the axis A.

The fourth crucible 16 is arranged centrically with respect to the axis A. A lid 17 having a centrically arranged opening 18 covers the fourth crucible 16. A fifth crucible 19 may be connected via a tube 19*a* with the opening 18 so that a melt can be poured from the fifth crucible 19 through the opening 18 into the fourth crucible 16.

By using the first device a precision casting may be produced as follows:

A titanium aluminide ingot is placed in the second crucible 8. The respective titanium aluminide alloy may have e.g. one of the following compositions:

a) 31 wt. % Al, 5 wt. % Nb, 1.5 wt. % Mn, 0.3 wt. % B and as balance Ti as well as unavoidable impurities;
b) 43 wt. % Al, 2 wt. % Nb and as balance Ti as well as unavoidable impurities;
c) 33 wt. % Al, 5 wt. % Nb, 2.5 wt. % Cr and as balance Ti as well as unavoidable impurities.

A mold which may be made of a ceramic being lined at there interior contact surface with $Y_2O_3$ is preheated in a furnace up to a temperature of around 1000° C. Suitable materials for the production of a mold are for example disclosed in the WO 2005/039803 A2.

The mold 4 being preheated to a temperature of around 1000° C. is mounted at the arm 2 and then covered with the piston 3 which is mounted in a gas-tight manner at the arm 2. In dependency on the number of arms 2 provided at the rotor 1 a multitude of molds 4 can be mounted at the rotor 1.

The ingot is then melt by inducing currents with the induction-coil 7. When the melt has reached a temperature in the range of 1400° C. to 1700° C., preferably in the range of 1450° C. to 1650° C., the rotor 1 is accelerated within 0.5 to 2.0 seconds, preferably within less than 1.5 seconds, upon rotational speed of 110 to 260 rpm, preferably with 100 to 160 rpm. The second radius r2 is in this case chosen to be 300 to 400 mm, preferably around 350 mm. The melt is forced by centrifugal forces from the second crucible 8 into the mold 4.

Afterwards the mold 4 has been filled with melt the rotor 1 is furtheron rotated at a rotational speed of 110 to 260 rpm, preferably of at least 160 rpm, for at least 60 seconds, preferably for 120 to 300 seconds. During the further rotation of the rotor 1 the rotational speed may be increased at a constant rate, e.g. from initial rotational speed selected from a range of 110 to 160 rpm to a rotational speed selected from a range of 180 to 260 rpm when the solidifying melt in the mold 4 has reached predetermined cooling-temperature in the range of 1300° C. to 1100° C.

The temperature of the solidifying melt in the mold 4 may be determined by conventional temperature measuring techniques using for example a thermocouple. The temperature values measured therewith may be corrected in accordance with a suitable algorithm in a conventional manner.

When the rotation of the rotor 1 has been stopped the mold 4 is demounted from the arm 2 and then placed in the furnace which is preheated on a temperature of around 1000° C. The mold 4 is then cooled down within the furnace with a rate of 50° C. to 100° C. per hour.

According to an embodiment of the aforementioned method the rotor 1 may be evacuated before melting the ingot within the second crucible 8. The vacuum within the rotor 1 may be in the range of $10^{-1}$ to $10^{-2}$ bar. Alternatively the rotor 1 may be flooded with shield gas, for example Ar before melting the ingot.

By use of the second device precision castings by centrifugal casting can be produced as follows:

Molds 4 are preheated in a similar manner as described above in a furnace up to a temperature of 1000° C. and then placed in suitable holding devices provided within the rotor 1.

The rotor 1 is accelerated upon a rotational speed in the range of 110 to 260 rpm. As soon as the melt has reached a predetermined temperature in the range of 1450° C. to 1650° C. the melt taken up in the fifth crucible 19 is poured into the fourth crucible 16. The melt is than forced through the outlet openings 9 provided at the fourth crucible 16 in the molds 4 which are located vis-à-vis.

Afterwards, the rotor 1 is furtheron rotated as described above. After stopping the rotation the molds 4 are demounted from the rotor 1 and cooled down as described above.

Figure 3A:
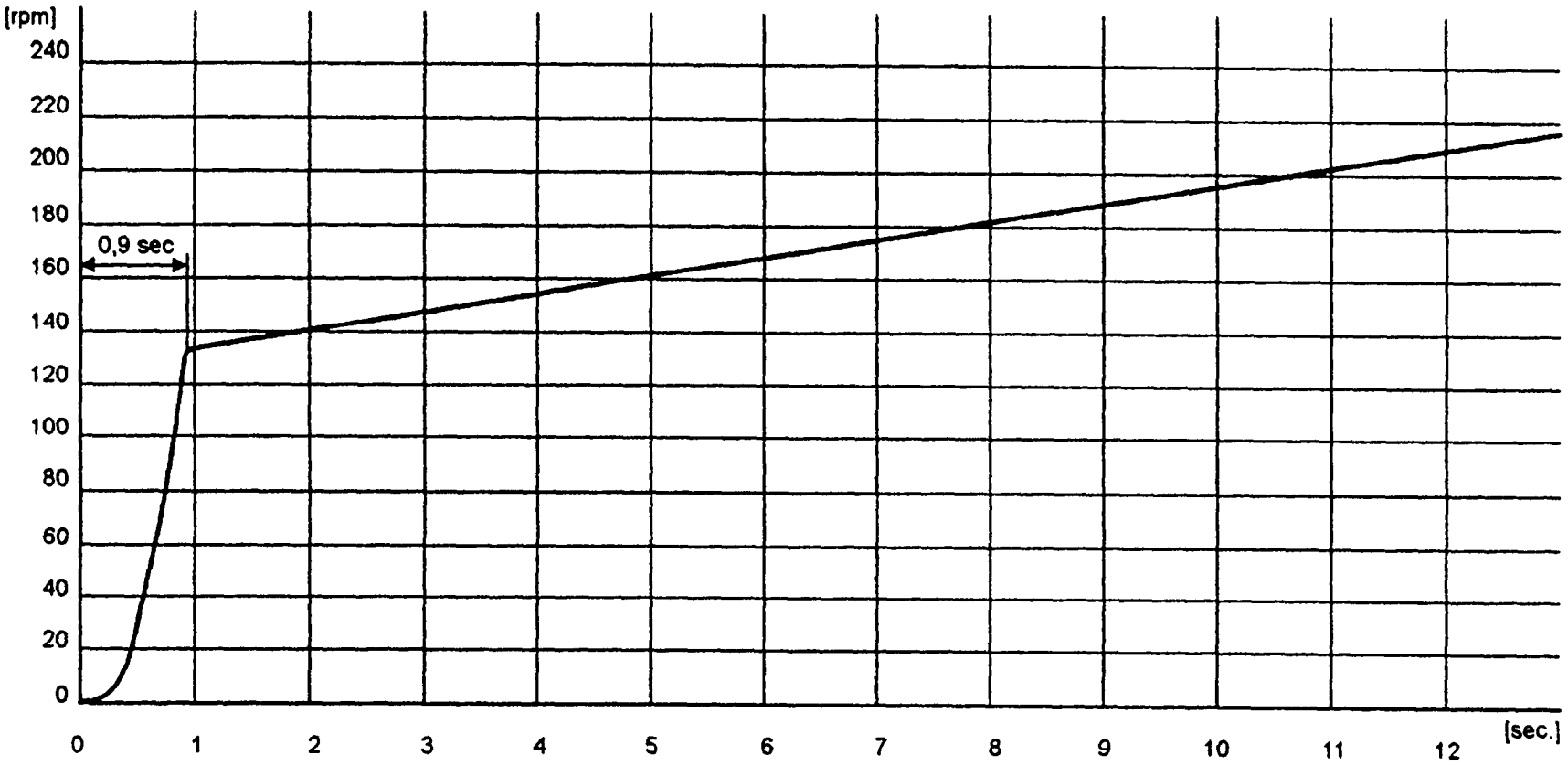
FIG. 3*a* shows a first plot of the rotational speed of a rotor over the time.
Figure 3B:
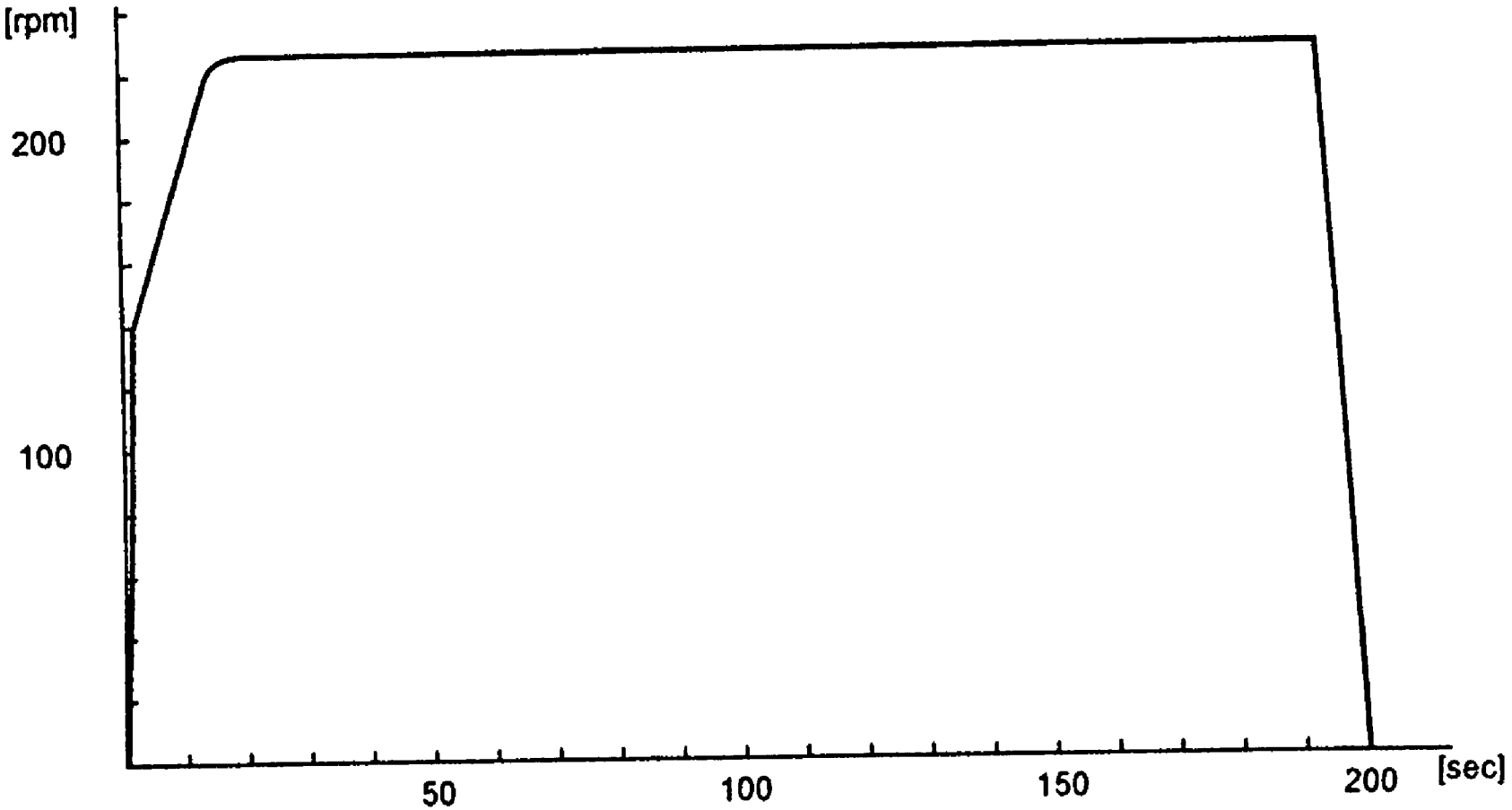
FIG. 3*b* shows a second plot of the rotational speed of a rotor over the time.

FIGS. 3*a* and 3*b* show plots of the rotational speed of the rotor above the time. In FIG. 3*a* the acceleration of the rotor during the first 12 seconds from the beginning of the rotation is showed. FIG. 3*b* shows a rotational speed of the rotor from the beginning of the rotation until the rotation is stopped.

When using the first device an ingot is melt within the second crucible 8. As soon as predetermined temperature of the melt has been reached the rotor 1 is accelerated within less then one second up to a rotational speed of around 140 rpm. Observations have shown that the melt is completely forced into the mold one second after starting the rotation of the rotor 1. As can be seen from FIG. 3*a* it is preferred to increase the rotational speed of the rotor 1 after the first second from around 140 rpm with a constant rate of 200 to 280 $rpm^2$, preferably with a rate of 240 $rpm^2$, so that around 14 seconds after the beginning of the rotation a rotational speed of around 220 to 240 rpm has been reached. When reaching the predetermined maximum rotational speed in the range of 200 to 250 rpm the rotor is furtheron rotated at a constant rotational speed. As can be seen from FIG. 3*b* this rotational speed may be in the range of 220 to 240 rpm, in particular around 225 rpm. Around 220 to 240 seconds after the beginning of the rotation of the rotor 1 the rotation is stopped.

When using the second device shown in FIG. 2 the melt is poured from the fifth crucible 19 into the fourth crucible 16 for example around 0.5 to 1.0 seconds after the rotation of the rotor 1 has been started, e.g. at a moment when the rotor rotates with a speed of around 140 rpm. Then the rotational speed the rotor 1 may be increased as shown in FIG. 3*a* at a constant rate until the rotor 1 has reached a rotational speed in the range of 200 to 240 rpm. Then the rotor 1 may be rotated at a constant speed in the range of 200 to 250 rpm for around two to four minutes.

By the proposed exerting of a centrifugal force on the solidifying melt in particular the formation of hot tears can be successfully be avoided. In the production of castings made from titan aluminides it has been proven to be advantageous to stop the exerting of the centrifugal force after the solidifying melt has reached a temperature which is lower than the brittle-ductile transition temperature of the material. Further, it is advantageous to increase the centrifugal force after the mold has completely being filled at the time when the melt is hot and mobile.

FIGS. 4 to 9 show in more detail the arrangement of the mold 4, in particular the cavity 20 thereof, with respect to a radial plane P and/or a horizontal plane HP of the rotor 1.

Figure 4:
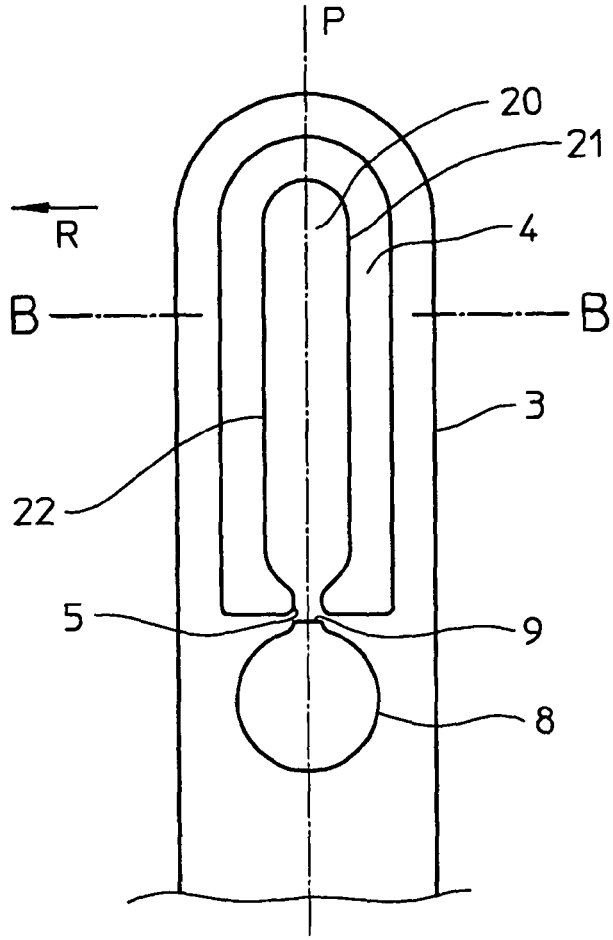
FIG. 4 shows a sectional drawing through an arm of the rotor of FIG. 1.

FIG. 4 shows a sectional drawing through an arm 2 of a rotor 1 like in FIG. 1. The cavity 20 of the mold 4 is extending in a radial direction. A mold leading edge 21 is arranged relative to the rotational direction R of the rotor 1 behind a axial plane P which includes the axis A and runs essentially in parallel to the radially extending side faces of the arm 2 or the piston 3. A mold flowing-off edge 22 is arranged at the opposite side of this axial plane P.

Figure 5:
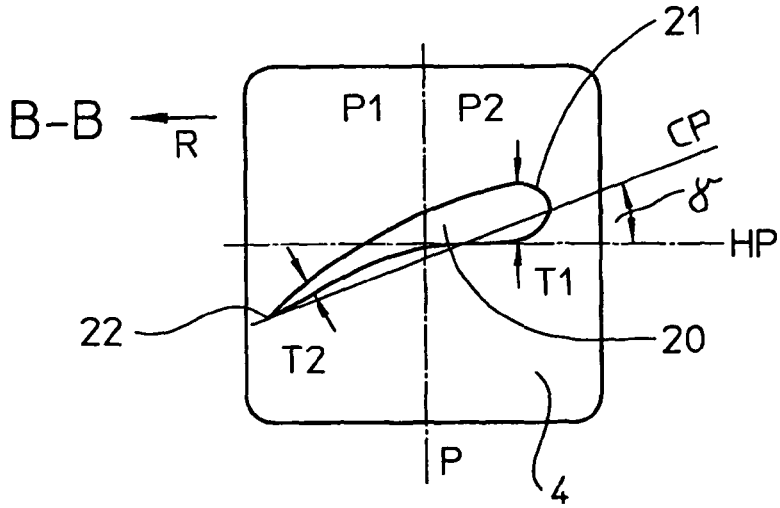
FIG. 5 shows a sectional drawing according to the section line B-B in FIG. 4.

FIG. 5 shows a schematic cross-section along the section line B-B in FIG. 4. As can be seen therefrom the mold leading edge 21 is situated in the vicinity of a portion of the mold 4 having a first mold thickness T1 which corresponds to a first thickness of a turbine blade manufactured by use of such a mold 4. The mold flowing-off edge 2 is situated in the vicinity of a portion of the mold 4 having second mold thickness T2 which corresponds to a second thickness of a turbine blade manufactured by use of this mold 4. The axial plane P devices the cavity 20 into two parts, a first part P1 being situated in the rotational direction R and a second part P2 being arranged against the rotational direction R. According to the present invention the cavity 20 is arranged always such that the mold leading edge 21 lies in the second part P2, i.e. is arranged against the rotational direction R of the rotor 1. A connecting plane CP connecting the mold leading edge 21 and the mold flowing-off edge 22 forms a tilting angle $\gamma$ with the horizontal plane HP.

Figure 7:
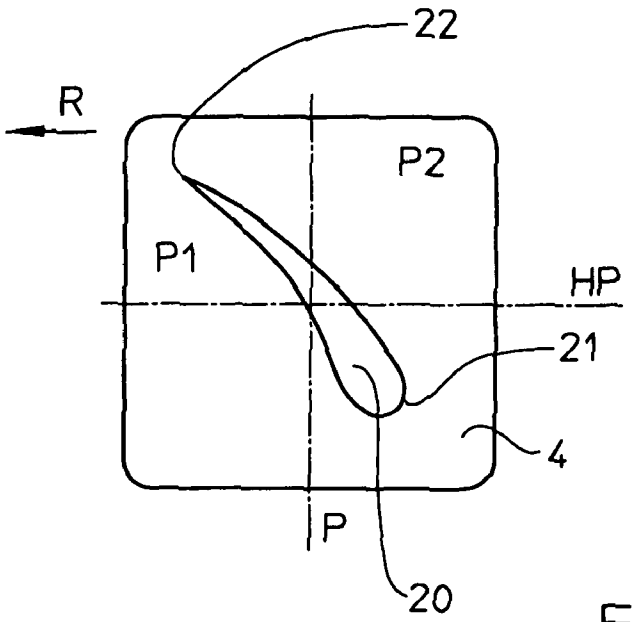
FIG. 7 shows another sectional drawing according to FIG. 5.
Figure 6:
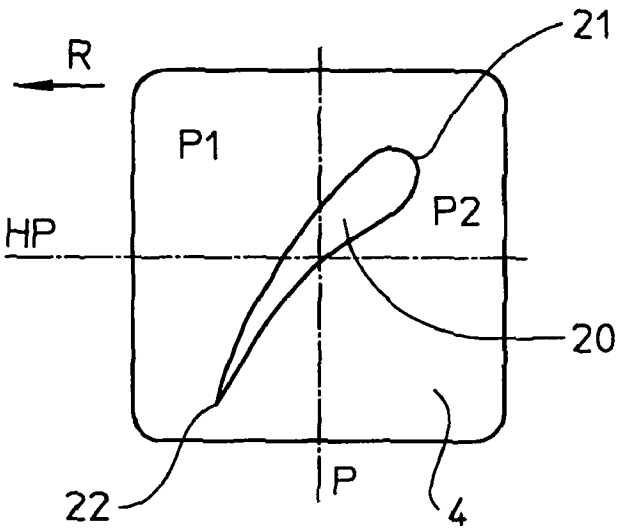
FIG. 6 shows another sectional drawing according to FIG. 5.

FIGS. 6 and 7 show for clarification that in this view also other arrangements of the mold leading edge 21 are possible. Also in the embodiments shown in FIGS. 7 and 8 the mold leading edge 21 lies in the second part P2. According to a preferred feature of the invention the tilting angle $\gamma$ is up to +/−30° with respect to the radial or horizontal plane HP.

Figure 8:
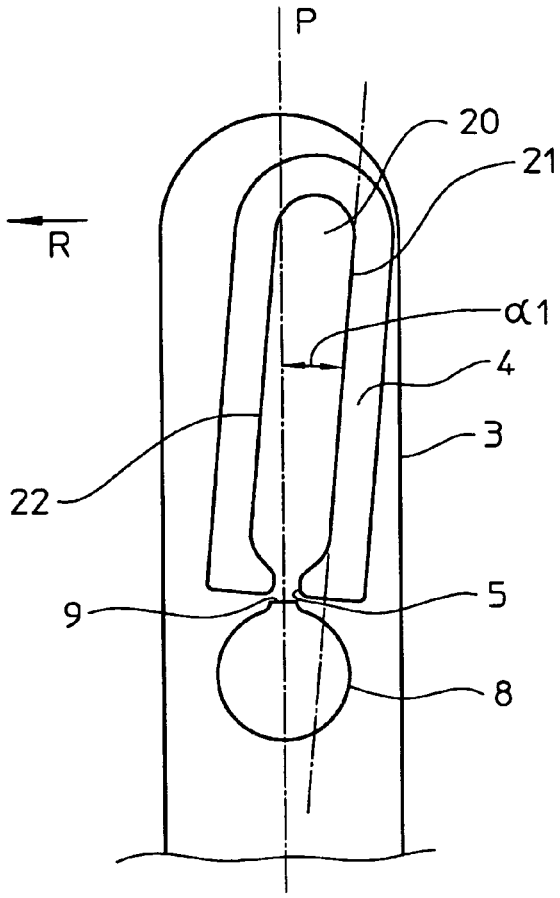
FIG. 8 shows a sectional drawing through an embodiment of an arm of the rotor of FIG. 1.
Figure 9:
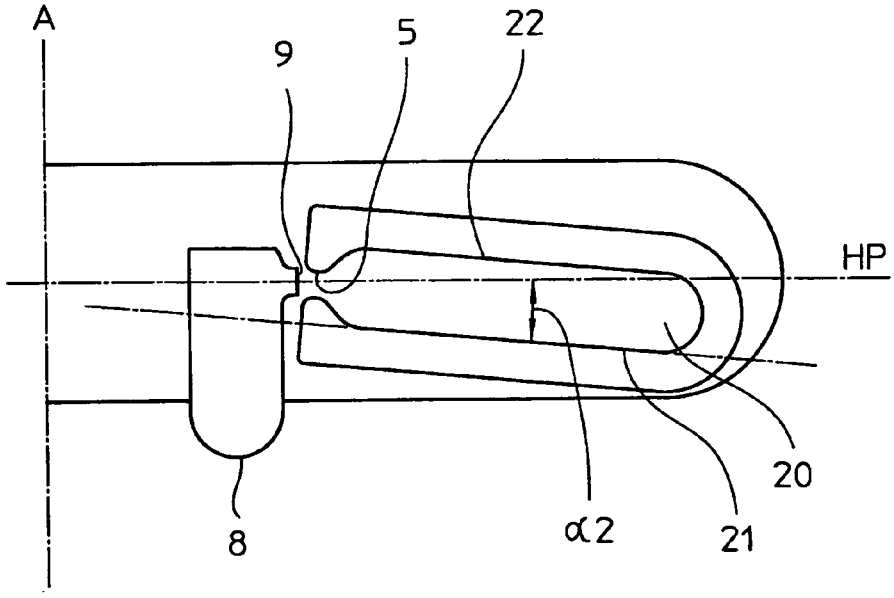
FIG. 9 shows a sectional drawing through a further embodiment of an arm of the rotor of FIG. 1.

FIGS. 8 and 9 show further embodiments of the invention. As can be seen from FIG. 8 the mold 4 can be arranged in the horizontal plane such that the mold leading edge 21 is inclined with respect to the axial plane P or the radial direction of the arm 2 or the piston 3, respectively, at a first angle $\alpha$1. The first angle $\alpha$1 opens in a direction against the rotational direction R of the rotor 1, i.e. the cavity 20 is inclined against the rotational direction R.

As can be seen from FIG. 9 it is also possible to arrange the mold 4 within the arm 2 or the piston 3, respectively, such that the mold leading edge 21 is inclined with respect to a horizontal plane HP at a second angle $\alpha$2. The second angle $\alpha$2 may open in a direction of gravity, as shown in FIG. 9. However, it is also possible that the second angle $\alpha$2 opens in the opposite direction, i.e. against the direction of gravity.

It has to be noted that the embodiments shown in FIGS. 8 and 9 can be combined, i.e. the mold leading edge 21 may be inclined at a first angle $\alpha$1 with respect to the axial plane P as well as a second angle $\alpha$2 with respect to the horizontal plane HP. The first $\alpha$1 and/or second angle $\alpha$2 may be preferably up to 30°.

In the embodiments shown in FIGS. 8 and 9 the mold 4 is taken up in the arm 2 such that the mold leading edge 21 is inclined with respect to the axial plane P and/or horizontal plane HP. Therefore, the axial plane P and/or horizontal plane HP just partly traverses the mold cavity 20. However, also in the embodiments shown in FIGS. 8 and 9 the mold 4 may be arranged such that the mold leading edge 21 is arranged in a direction against the rotational direction R of the rotor 1.

By the proposed arrangement of a mold leading edge 21 with respect to the axial plane P and/or horizontal plane HP there can be manufactured a turbine blade with a strongly improved internal structure, i.e. the formation of pores and shrink-holes can be reduced remarkably. It is assumed that this effect is caused by Coriolis-forces which act upon the melt being cast into the cavity 20. According to the present invention the mold 4 is arranged such that the Coriolis-forces act with a high efficiency upon the first portion of the mold 4 which has a high thickness. By the Coriolis-forces a high additional pressure is created by which the formation of pores and shrinkholes in this thick portion is remarkably reduced.

The invention claimed is:

1. A method for production of a turbine blade by centrifugal casting, the turbine blade having a leading edge portion with a first thickness and a flowing-off edge portion with a second thickness being smaller than the first thickness, comprising the following steps:

a) providing a centrifugal casting device having a rotor being rotatable around an axis, and at least one crucible being accommodated in the rotor, the crucible having at least one outlet opening, b) providing a mold having an extended cavity for forming the turbine blade, c) arranging the mold at a radially outward position with respect to the crucible, so that an inlet opening of the mold is arranged vis-a-vis with an outlet opening of the crucible, and further arranging the mold so that a direction from the flowing-off edge to the leading edge of the turbine blade, is directed in a direction against the rotational direction of the rotor, d) rotating the rotor and thereby forcing a metal melt by means of centrifugal forces from the crucible into the mold, e) exerting a pressure on the melt being forced into the mold until the temperature of the solidifying melt has reached a predetermined cooling-temperature, and f) relieving the pressure when the temperature of the solidifying melt is smaller than said predetermined cooling-temperature.

2. The method of claim 1, wherein the mold leading edge is arranged in a radial plane at a first angle, of up to 30°, relative to the radial direction of the rotor.

3. The method of claim 2, wherein the first angle opens in a direction against the direction of rotation of the rotor.

4. The method of claim 2, wherein the mold leading edge is arranged in an axial plane at a second angle, of up to 30°, relative to the radial direction of the rotor.

5. The method of claim 1, wherein the predetermined cooling temperature is in a range of 1300° to 800° C.

6. The method of claim 1, wherein the pressure corresponds to the centrifugal force acting on the melt at a moment when the mold completely filled times a factor of 1.0 to 5.0.

7. The method of claim 1, wherein the pressure is exerted upon the melt for 1 to 6 minutes after the predetermined cooling-temperature has been reached.

8. The method of claim 1, wherein the pressure exerted upon the melt is a constant or an increasing pressure.

9. The method of claim 1, wherein the rotor is rotated with the same or an increasing speed during step e).

10. The method of claim 1, wherein the melt is heated up to a temperature which is 50° to 150° C. higher that the melting-temperature of the metal.

11. The method of claim 1, wherein the mold is preheated before step c).

12. The method of claim 11, wherein the temperature of preheating is in the range of 50 to 1100° C.

13. The method of claim 1, wherein the predetermined cooling-temperature is in a range of 1050° C. to 800° C.

14. The method of claim 1, wherein the pressure is exerted upon the melt by rotating the rotor.

15. The method of claim 1, wherein the pressure is exerted upon the melt by pressurized gas.

16. The method of claim 1, wherein during steps d) and e), the melt is under vacuum or shield gas.

17. The method of claim 1, wherein the solidifying melt is cooled down to room temperature after step e) at a cooling-rate of 50° C. to 150° per hour.

18. The method of claim 1, wherein the metal melt consists of a titanium alloy.

19. The method of claim 18, wherein the titanium alloy comprises Ti and Al as main constituents and wherein the titanium alloy is a γ-TiAl based alloy of the following composition:

$$Ti_{45\text{-}52\ at.\ \%}Al_{45\text{-}48\ at.\ \%}X1_{1\text{-}3\ at.\ \%}X2_{2\text{-}4\ at.\ \%}X3_{1\ at.\ \%},$$

where

X1=Cr, Mn, V

X2=Nb, Ta, W, Mo

X3=Si, B, C.

20. The method of claim 19, wherein the titanium alloy contains 30 to 45 wt. % Al, 1.5 to 6 wt. % Nb and as balance Ti as well as unavoidable impurities.

21. The method of claim 20, wherein the titanium alloy additional contains one of more of further constituents: 0.5 to 3.0 wt. % Mn, 0.1 to 0.5 wt. % B, 1.5 to 3.5 wt. % Cr.

22. The method of claim 21, wherein the titanium alloy contains O in an amount of 0 to 1000 ppm, C in an amount of 0 to 1000 ppm, Ni in an amount of 100 to 1000 ppm and N in an amount of 0 to 1000 ppm.

23. The method of claim 1, wherein the metal melt is created within the crucible.

24. The method of claim 1, wherein the crucible is accommodated in the rotor in a second radial distance from the axis, the second radial distance being smaller than the first radial distance.

25. The method of claim 1, wherein the melt is created in the crucible while the rotor is standing.

26. The method of claim 1, wherein the melt is created by inductively heating an ingot within the crucible.

27. The method of claim 1, wherein the metal melt is poured into the crucible.

28. The method of claim 1, wherein the melt is poured into the crucible while the rotor is rotating.

29. The method of claim 27, wherein the crucible has a form of a ring-shaped channel being centrally accommodated in the rotor, the outer circumference of which has a second radial distance from the axis, the second radial distance being smaller than the first radial distance.

* * * * *